US005670025A

United States Patent [19]

Baird

[11] Patent Number: 5,670,025

[45] Date of Patent: Sep. 23, 1997

[54] COKE OVEN DOOR WITH MULTI-LATCH SEALING SYSTEM

[75] Inventor: William Baird, Sturgis, Ky.

[73] Assignee: Saturn Machine & Welding Co., Inc., Sturgis, Ky.

[21] Appl. No.: 519,408

[22] Filed: Aug. 24, 1995

[51] Int. Cl.[6] ..... C10B 25/04; C10B 25/10

[52] U.S. Cl. ..... 202/248; 202/190; 202/239; 202/249; 202/262

[58] Field of Search ..... 202/190, 239, 202/248, 249, 262

[56] References Cited

U.S. PATENT DOCUMENTS

| | | |
|---|---|---|
| Re. 20,515 | 9/1937 | Van Ackeren . |
| Re. 34,184 | 2/1993 | Baird et al. . |
| 725,745 | 4/1903 | Moore . |
| 736,281 | 8/1903 | MacDougall . |
| 998,642 | 7/1911 | Shean . |
| 1,399,594 | 12/1921 | Wilputte . |
| 2,157,568 | 5/1939 | Potter . |
| 2,157,569 | 5/1939 | Potter . |
| 2,195,840 | 4/1940 | Potter . |
| 2,235,686 | 3/1941 | Potter . |
| 2,338,675 | 1/1944 | Van Ackeren . |
| 2,759,884 | 8/1956 | Gillott . |
| 3,043,605 | 7/1962 | McKay . |
| 3,275,360 | 9/1966 | Tucker . |
| 3,392,490 | 7/1968 | Rami . |
| 3,486,986 | 12/1969 | Freund . |
| 3,510,404 | 5/1970 | Freund . |
| 3,660,859 | 5/1972 | McCullough . |
| 3,681,201 | 8/1972 | McCullough . |
| 3,876,506 | 4/1975 | Dix et al. . |
| 3,902,274 | 9/1975 | Ikio . |
| 4,033,828 | 7/1977 | Morrow et al. . |
| 4,080,266 | 3/1978 | Dix . |
| 4,086,231 | 4/1978 | Ikio . |
| 4,107,879 | 8/1978 | Steimann . |
| 4,110,173 | 8/1978 | Dix . |
| 4,115,203 | 9/1978 | Naevestad . |
| 4,124,451 | 11/1978 | Dix et al. . |
| 4,131,421 | 12/1978 | Abendroth . |
| 4,176,013 | 11/1979 | Garthus et al. . |
| 4,198,274 | 4/1980 | Ikio . |
| 4,295,938 | 10/1981 | Haaf . |
| 4,333,910 | 6/1982 | Lorrek et al. . |
| 4,372,820 | 2/1983 | Naevestad . |
| 4,427,494 | 1/1984 | Naevestad . |

(List continued on next page.)

FOREIGN PATENT DOCUMENTS

| | | |
|---|---|---|
| 363948 | 11/1922 | Germany . |
| 536358 | 10/1931 | Germany . |
| 1809880 | 6/1970 | Germany . |
| 2629354 | 5/1978 | Germany . |
| 3913083 | 6/1990 | Germany . |
| 496187 | 11/1938 | United Kingdom . |
| 929161 | 6/1963 | United Kingdom . |

*Primary Examiner*—Timothy McMahon
*Attorney, Agent, or Firm*—Wood, Herron & Evans

[57] ABSTRACT

A coke oven door for placement against a door jamb of a coke oven comprises a segmented door body and plurality of toggle mechanisms coupled to the door at the juncture of each segment. The toggle mechanisms include inner and outer toggle links pivotally connected by an intermediate pivot shaft and the links are pivotable between an extended length and a shortened length. Inner ends of the toggle mechanism are coupled to the segmented door body and outer ends of the toggle mechanisms are coupled to a flexible latch tension bar. The latch tension bar engages latch hooks connected to the door jamb and vertical movement of a latch actuator rod coupled to the intermediate pivot shaft moves the toggle mechanisms to an extended position to flex the latch tension bars and force the door body against the door jamb to seal the coke oven. Vertical translation of the actuator rod simultaneously extends each toggle mechanism to latch the door, and each latch tension bar provides an independent sealing force on the door such that an improved seal is maintained with better relative parallelism between the door body segments and the door jamb.

28 Claims, 3 Drawing Sheets

U.S. PATENT DOCUMENTS 4,429,908 2/1984 Ernst .
4,439,277 3/1984 Dix .
4,532,010 7/1985 Dürslen et al. .
4,574,035 3/1986 Highley et al. .
4,647,343 3/1987 Stog et al. .
4,676,873 6/1987 Haaf et al. .
4,741,808 5/1988 Holz et al. .
4,892,338 1/1990 Weinerman et al. .
4,952,284 8/1990 Becker .
5,238,539 8/1993 Baird .

COKE OVEN DOOR WITH MULTI-LATCH SEALING SYSTEM

FIELD OF THE INVENTION

This invention relates generally to coke oven doors and specifically to a coke oven door utilizing a unique multi-latch sealing system for effecting an improved seal of the door to a coke oven door jamb.

BACKGROUND OF THE INVENTION

Coke oven doors are used to close and seal the openings of coke ovens and generally have a very heavy construction to withstand the high temperatures and physical rigors of the coke oven environment. Typical coke oven doors include a rigid door body which is positioned adjacent the door jamb of the coke oven. A sealing structure, usually including a knife edge, surrounds the door body and is forced into engagement with the surface of the jamb to seal the oven when the door is closed.

To latch the conventional door, two rotatable, compression spring-biased latching mechanisms are coupled to the door, with one being positioned in the upper half of the door and the other being positioned approximately 80 or more inches below, in the lower half of the door. Each latching mechanism includes elongated arms which fit into slots of a latch structure coupled to the door jamb. When the door is positioned adjacent the door jamb and the door sealing edge is positioned against the jamb, the latching mechanisms are pushed inwardly toward the door jamb and against the bias of the compression springs. The mechanism arms are then rotated to position the arms in the slots. The force generated by compression of the springs within the mechanisms acts against the door jamb latch structure through the arms to thereby force the door knife sealing edge against the door jamb of the oven.

Although coke oven doors utilize a rigid door body and a sharp sealing structure for a tight seal against the door jamb, conventional oven doors often do not fit evenly against the jamb and thus do not create an even seal about the entire circumference of the door. Because of the high temperatures within a coke oven, the door jamb often becomes warped and distorted. Therefore, a proper seal cannot be maintained because the rigid door body is unable to conform to the unique contours of the warped door jamb. Furthermore, deposits of carbon tend to coat the door jamb further changing the shape of the jamb and degrading the seal between the door and the jamb.

An additional disadvantage of conventional coke oven doors is the inability of the latching structures to securely seal the door body against the jamb along the length of the door. Specifically, conventional coke oven doors utilize only two rotatable latching mechanisms which are spaced approximately eighty inches or more apart. The latching mechanisms provide localized force at two positions along the door; however, such widely spaced localized sealing forces are oftentimes insufficient for maintaining a tight seal against the door jamb, particularly when the door jamb has been warped. Still further, to latch and unlatch conventional coke oven doors, a large and complex door extractor is utilized to simultaneously engage both latching mechanisms to push the mechanisms inwardly at both positions, rotate the arms and pull away or push the door toward the door jamb. Adding latching mechanisms to the conventional two latching structures has proven undesirable in the past because each latching mechanism must be individually engaged and manipulated by the door extractor. Therefore, increasing the number of rotating latching mechanisms on the door, only increases the cost and complexity of the door extractor necessary to seal and unseal the door.

An attempt has been made to utilize a coke oven door latching system which includes two latching mechanisms which may be actuated from a single point on the door. However, the door includes only a single biasing structure which serves to bias all of the latching mechanisms. Accordingly, the force of the single biasing structure must be spread out over the length of the door and between each latching mechanism. This results in sealing forces which are often uneven, with one latching mechanism receiving a greater biasing force than another. As a result, the seal between the door body and the door jamb is still uneven.

Therefore, it is an objective of the present invention to create a tight and even seal between a coke oven door body and door jamb. It is particularly an objective to create an even seal when the door jamb has been warped by high temperatures and other oven conditions.

It is a further objective to effectively and consistently seal a coke oven door body against a door jamb and to maintain the relative parallelism between the door body sealing structure and the jamb even as the jamb undergoes distortion and warpage.

It is another objective of the present invention to create a stronger, more effective seal between the coke oven door body and door jamb. To that end, it is desirable to enhance the door seal with efficient distribution of multiple independent latching forces over the length and around the perimeter of the door.

It is still another objective to provide an even distribution of latching forces on a coke oven door body while being able to insert and latch the door, and subsequently unlatch and extract the door easily and efficiently without the need for a highly complex and costly door extracting device.

SUMMARY OF THE INVENTION

These objectives and other objectives are achieved by the coke oven door and multi-latch system of the present invention which comprises a segmented door body having segments which are operable to flex with respect to adjacent segments and a unique multi-latch system utilizing a plurality of toggle mechanisms at spaced locations along the length of the door. All of the toggle mechanisms provide independent sealing forces on the door but are simultaneously actuatable by a single vertically translatable actuator rod for efficiently and effectively sealing the door against the door jamb.

More specifically, the door body is segmented by a plurality of slots therein. The edges of the slots are held together at their outward ends by loose fitting control links so that the door may flex along its length. Preferably, a knife-edge sealing structure is positioned along the periphery of the door body to engage the door jamb and provide a tight seal.

A toggle mechanism is coupled to the door at each slot. Each toggle mechanism includes an inner toggle link and an outer toggle link which are pivotally connected together by an intermediate toggle pivot shaft. The inner end of the inner toggle link is pivotally coupled to the door body by an inner pivot shaft while the outer end of the outer toggle link is pivotally coupled to a flexible latch tension bar. Each individual toggle mechanism includes its own independent latch tension bar for providing an independent and localized sealing force against the door without being affected by the sealing forces provided by the latch tension bars of the other toggle mechanisms.

To operate the multi-latch system of the present invention and seal the coke oven door, the door is positioned against the door jamb such that the ends of the latch tension bar of each toggle mechanism are positioned above respective latch hooks attached to the door jamb. The latch actuator rod, which is coupled to the intermediate toggle pivot shaft of each toggle mechanism, is moved vertically downward by sliding a disk connected to the actuator rod downwardly. As the latch actuator rod vertically moves the intermediate toggle pivot shaft downwardly, the latch tension bar ends engage the latch hooks and the inner and outer toggle links pivot. When the toggle links pivot, each toggle mechanism extends from a shortened length to an extended length between the door body and the latch tension bar. The latch tension bar is held at its ends by the latch hooks and the bar flexes at its center under the force of the extended latch mechanism. The flexing of the latch tension bar provides an inward latching force on the toggle which is translated to the segmented door body. The latching force is directed generally perpendicular to the door body and in the direction of the door jamb. Therefore, each toggle mechanism independently provides a latching force against the door, and since the toggle mechanisms are spaced along the length of the door, the door body is effectively and tightly sealed against the door jamb completely around its periphery. Each inner toggle link includes a stop structure formed thereon. When the intermediate toggle pivot shaft travels downwardly and breaks over a center plane between the inner pivot shaft and outer pivot shaft the stop structure engages the intermediate pivot shaft and holds the toggle in an extended length until the latch actuator rod is again moved in the upward direction. Therefore, the door is tightly sealed to the jamb despite any jamb warpage.

Since the latching forces are provided by each toggle mechanism independently of the other toggle mechanisms, the latching forces on the door are distributed evenly and more consistently along the length of the door. Furthermore, the combination of the segmented door body and the independent latching forces provided by the individual toggle mechanisms provides parallel engagement between door body and door jamb even if the door jamb is warped or distorted.

To unlatch the door, the latch disk and latch actuator rod are moved vertically upwardly toward the top of the door. The stop structure of each toggle disengages and the intermediate toggle pivot shaft then moves upwardly to again pivot the inner and outer toggle links to move the toggle mechanism into an effectively shortened length. The shortened length of the toggle mechanisms relax the respective independent latch tension bars, while the upward movement of the toggle mechanisms removes the latch tension bars from the latch hooks to thereby unseal the door. The multi-latch system of the present invention is operated from a single position on the door, and all of the toggle mechanisms are unlatched in a single motion. Therefore, the door extractor device for extracting the door is much less complex than those currently in use which must engage two or more mechanisms at spaced positions along the door and rotate both mechanisms to unseal the door from the jamb.

In one preferred embodiment, the toggle mechanisms are positioned at the juncture of each pair of adjacent door body segments and are spaced approximately thirty-six inches apart.

The coke oven door and multi-latch system of the present invention provides a much greater and more efficient distribution of latching forces on the door. A combination of the unique multi-latch system and the segmented door body creates a flexible door which is adaptable and conformable even as the door jamb undergoes normally encountered distortion and warpage.

These and other objectives and advantages of the present invention will become more readily apparent from the following brief description of the drawings and detailed description of the invention set forth hereinbelow.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAIL DESCRIPTION OF SPECIFIC EMBODIMENTS

Figure 1:
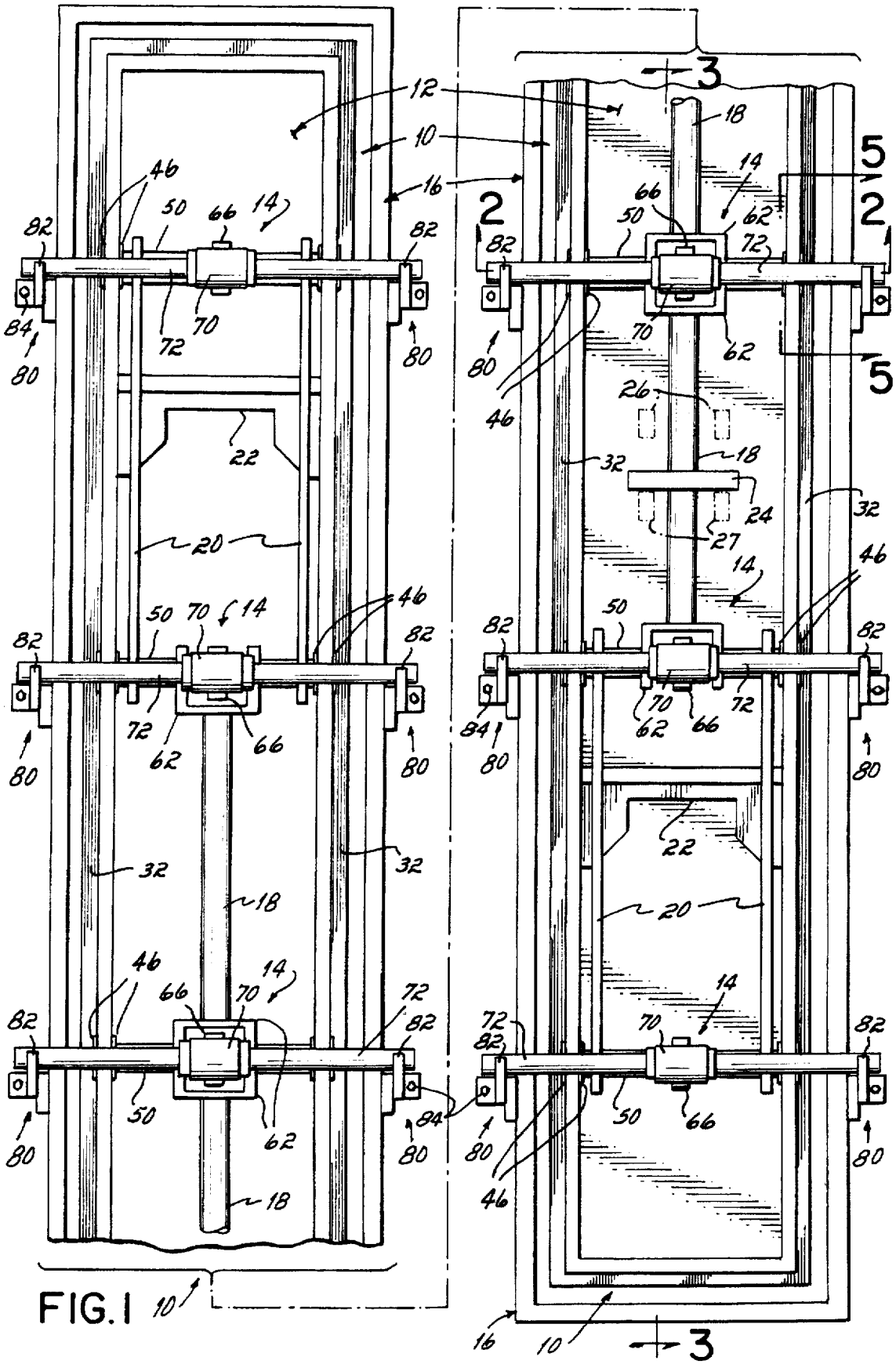
FIG. 1 is front view of a coke oven door of the present invention, partially broken to illustrate the entire length of the door.
Figure 2:
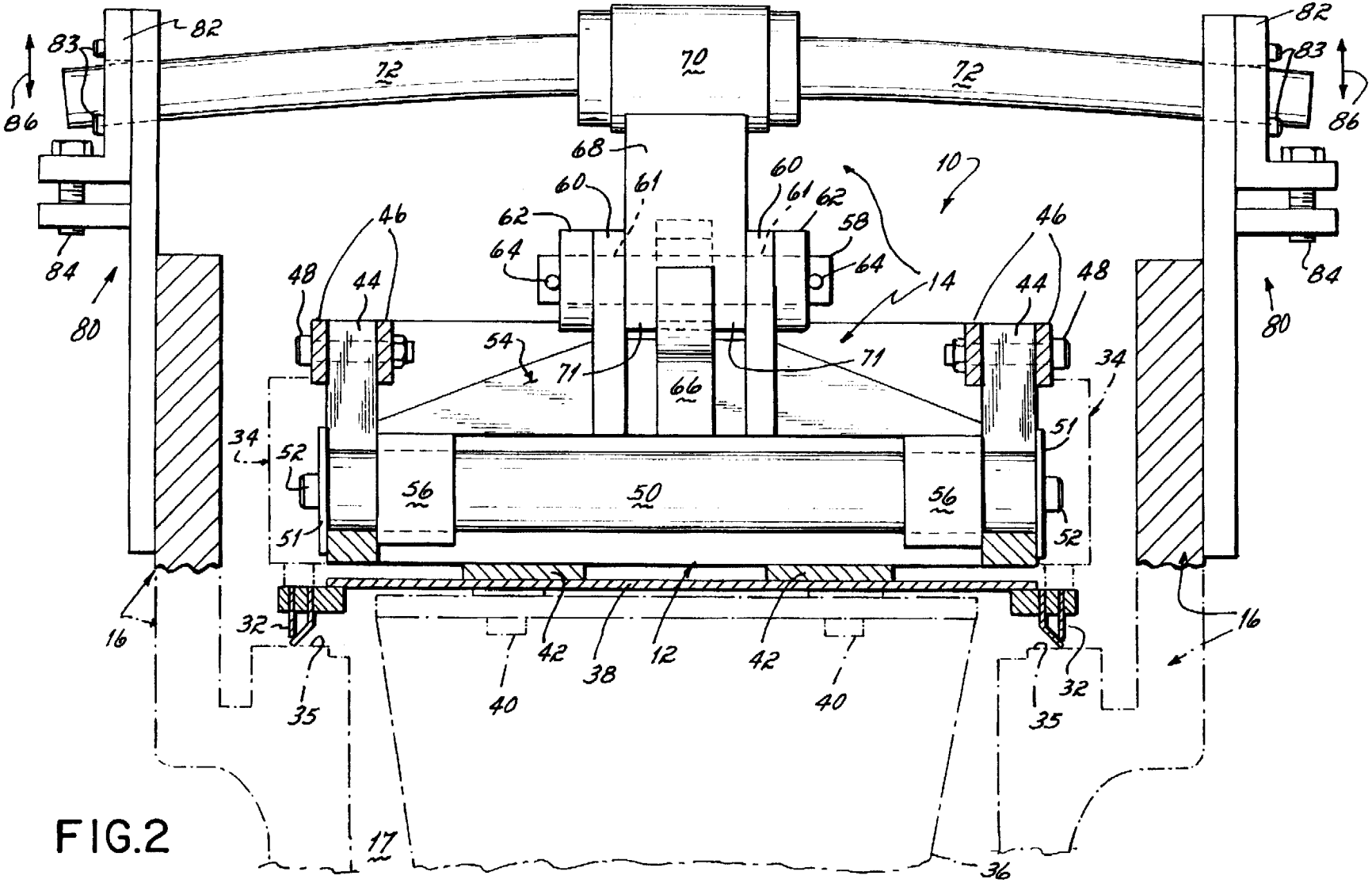
FIG. 2 is a cross-sectional view taken along line 2—2 of FIG. 1 illustrating the sealing of the coke oven door against a coke oven door jamb when the toggle mechanisms are in an extended position.

Coke oven door 10 of the present invention, as illustrated in FIG. 1, comprises a door body 12 and a plurality of toggle mechanisms 14 which are positioned at spaced locations along door body 12 to latch and seal the door body 12 against a door jamb 16 (see FIG. 2) to seal a coke oven 17 (see FIG. 2). Each toggle mechanism 14 is coupled to a latch actuator rod 18 positioned in the center of the door. The toggle mechanisms 14 are either directly connected to rod 18 or are indirectly connected by latch actuator links 20. The latch actuator links 20 are utilized toward the sides of the door body 12 to provide an open space on the top and bottom of the door to provide access for lift hooks of a door extractor device (not shown). The door extractor lift hooks fit within pocket structures 22 mounted on the front of the door for lifting door 10 and moving it away from the front of a coke oven after it has been unlatched. Links 20 are positioned proximate either side of the pocket structure 22. The latch actuator rod 18 and latch actuator links 20 are moved upwardly and downwardly by moving a lift plate or disk 24, which is coupled to latch actuator rod 18, either vertically upward or vertically downward between upper and lower elements 26, 27, respectively of a door extractor mechanism (not shown). Movement of the disk 24 and rod 18 upwardly by elements 27 unlatches and unseals the door 10, while downward movement by elements 26 latches and seals door 10.

FIG. 2 illustrates the coke oven door 10 of the present invention sealed against a coke oven door jamb 16. Door 10 includes a knife-edge door seal 32 which is spring biased by a biasing plunger mechanism 34, conventional in the art, fixed to the door body 12. When door body 12 is positioned against jamb 16, the door seal 32 is pressed against jamb surface 35 and ensures an effective and consistent seal even upon warpage of the jamb 16 or fouling of the jamb surface 35 with hard carbon deposits. An example of a suitable seal device is disclosed in U.S. Pat. No. 5,238,539 which is incorporated herein by reference in its entirety. Other seal devices might also be utilized.

On the inside surface of door 10, refractories 36 are mounted to a diaphragm plate 38 by a plurality of bolts 40 which extend through hangar bars 42. See U.S. Pat. No. 5,238,539 for further discussion regarding a suitable connection between the refractories 36 and door body 12.

Figure 5:
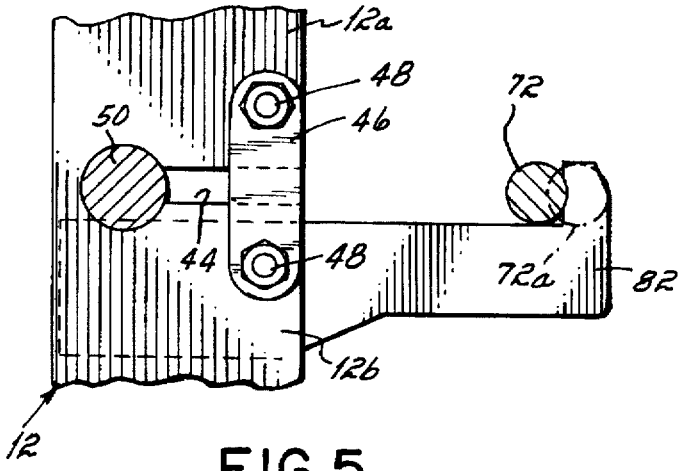

In accordance with the principles of the present invention, the door body 12 is segmented to be flexible along its length and is latched to jamb 16 by a multi-latch system comprising the plurality of toggle mechanisms 14. Referring to FIG. 5, door body 12 is effectively segmented by a plurality of slots 44 formed within the body 12 at vertically spaced positions. On either side of slot 44 the door body 12 is effectively divided into a segment 12*a* and an adjacent segment 12*b*. Door body 12 is flexible at slot 44 between the adjacent segments 12*a*, 12*b*. By allowing the door body 12 to flex, it is possible to maintain relative parallelism between the door body and the jamb surface 35 even as the jamb 16 undergoes normally encountered distortion and workage. Control links 46 connect the adjacent segments 12*a*, 12*b* together at the outer end of slot 44 and are attached to the segments 12*a*, 12*b* by appropriate bolts 48. Bolts 48 are loose fitting within links 46 to thereby allow door body 12 to have a degree of controlled flexibility about the slots 44.

As discussed further hereinbelow, a toggle mechanism 14 of the multi-latch system of the invention is preferably coupled to door body 12 at each slot 44. An inner toggle pivot shaft 50 is pivotally coupled at an inner end of slot 44 to provide connection of the toggle mechanisms with door body 12. In one preferred embodiment of the invention, the slots, and therefore the latching points along the length of the door body 12, are positioned approximately 36 inches apart. This is considerably less than the spacing of 80 inches or more which has been previously utilized with the latching mechanisms of conventional coke oven doors. The closer spacing is made possible by the fact that the toggle mechanisms 14 of the inventive multi-latch system do not require any rotation during the latch/unlatch process. This thereby allows a door extracting device (not shown) to serve all the latches from only one location.

Referring again to FIG. 2, each toggle mechanism 14 includes an inner toggle link pivot shaft 50 which is coupled to segmented door body 12 by a retention washer 51 and retention bolt 52. Shaft 50 rotates with respect to door body 12. An inner toggle link 54 is rotatably coupled to pivot shaft 50 by two opposing collars 56 positioned at either end of pivot shaft 50 adjacent the respective segments of door body 12. Inner toggle link 54 is rotatable about pivot shaft 50 (see FIGS. 4A, 4B). The end of inner toggle link 54 opposite pivot shaft 50 is coupled to an intermediate toggle link pivot shaft 58. Arms 60 of inner toggle link 54 have apertures 61 therethrough for engaging the intermediate toggle link pivot shaft 58 so that inner toggle link 54 may pivot with respect to both the inner pivot shaft 50 and the intermediate pivot shaft 58. A fork end 62 of the latch actuator rod 18 is also coupled to the intermediate pivot shaft 58 to move the intermediate pivot shaft upwardly and downwardly to latch and unlatch door 10 (FIG. 1). Intermediate pivot shaft 58 is held in position in arms 60 and fork 62 by retention pins 64. The inner toggle link 54 also includes a stop structure 66 for locking the toggle mechanism in an extended position to latch door 10 as described further hereinbelow.

Figure 4A:
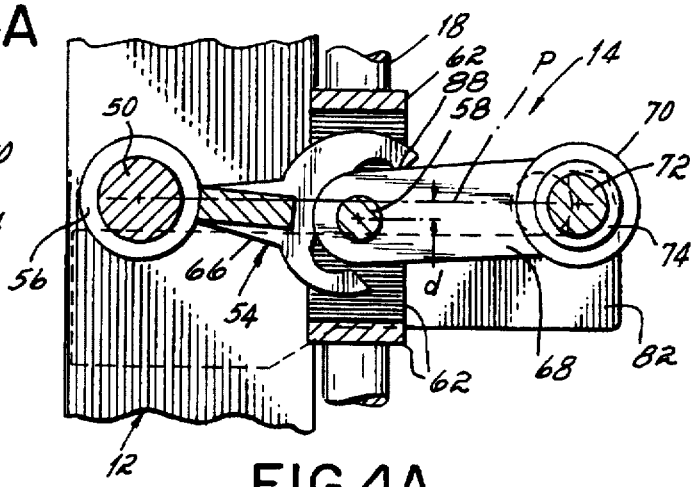
FIG. 4A is an enlarged cross-sectional view of the encircled area 4A illustrating a toggle mechanism in an extended position.

An outer toggle link 68 is also coupled to intermediate pivot shaft 58 and includes an outer collar 70 which surrounds an elongated, flexible latch tension bar 72. An inner collar 71 surrounds intermediate pivot shaft 58. Outer toggle link 68 pivots with respect to intermediate pivot shaft 58 and latch tension bar 72. A bushing 74 ensures proper rotation of link 68 about latch tension bar 72. As illustrated in FIG. 4A, each of the inner pivot shaft 50, intermediate pivot shaft 58, and latch tension bar 72 preferably have a circular cross-section for smooth pivoting.

Toggle mechanism 14 provides sealing pressure at each slotted juncture between adjacent door body segments such as segments 12*a* and 12*b*. Each toggle mechanism 14 is operable to be moved between a latch position (FIG. 4A), wherein the toggle mechanism has an effectively extended physical length and an unlatch position (FIG. 4B) wherein the toggle mechanism 14 has an effectively shortened length to unlatch the door 10 and essentially unseal the door from jamb 16 in the respective coke oven.

Aligned pairs of jamb hook plates 80 are connected to door jamb 16, one on either side of the door jamb. Connected to each jamb hook plate is an adjustable latch hook 82 which is held to the jamb hook plate by attachment bolts 83. An adjusting bolt 84 couples a flange of latch hook 82 to another flange connected to hook plate 80. Hook 82 is slotted with horizontal slots (not shown) to allow lateral movement of the latch hooks 82 toward and away from the door jamb 16 as illustrated by arrow 86. Adjustment of the latch hooks 82 increases or decreases the sealing pressure placed on door body 12 by the toggle mechanisms 14 by increasing or decreasing the distance that latch tension bar 72 is flexed.

Figure 4B:
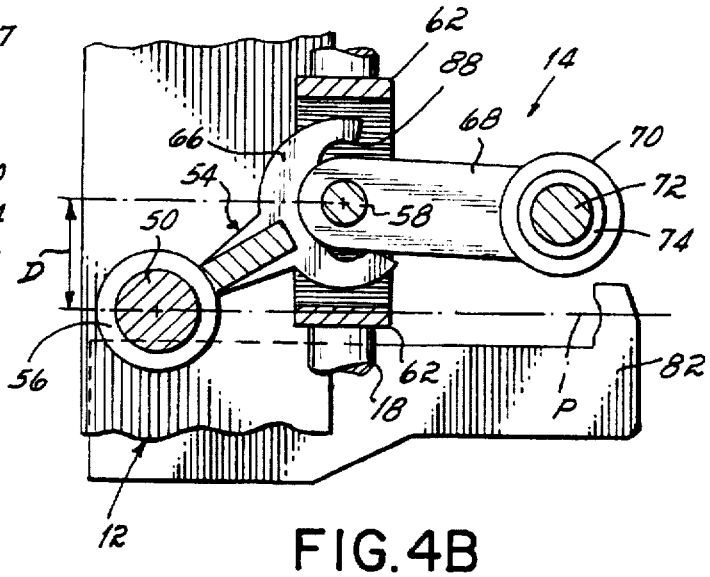
FIG. 4B is an enlarged cross-sectional view of a toggle mechanism in a shortened position; and, FIG. 5 is a partial cross-sectional view taken along line of 5—5 FIG. 1 to illustrate the segmented coke oven door body.

Referring to FIG. 4B, when the latch actuator rod 18 rests in an upward position, the toggle mechanisms 14 are unlatched and have an effective shortened length. The latch tension bar 72 is positioned above the latch hooks 82 and the toggle mechanisms are unlatched to unseal door body 12 from door jamb 16. When the latch actuator rod 18 is moved downwardly (as by element 26 of an extractor mechanism) to latch the toggle mechanism the latch tension bar is vertically lowered into engagement with the latch hooks 82 proximate either end of the latch tension bar 72 (see FIG. 4A). As the actuator rod 18 continues its downward motion, the toggle links 54, 68 pivot away from each other and the intermediate toggle link pivot shaft 58 is drawn downwardly a distance D into a horizontal plane passing through the center of both the inner toggle link pivot shaft 50 and latch tension bar 72 (see FIG. 4B).

Figure 3:
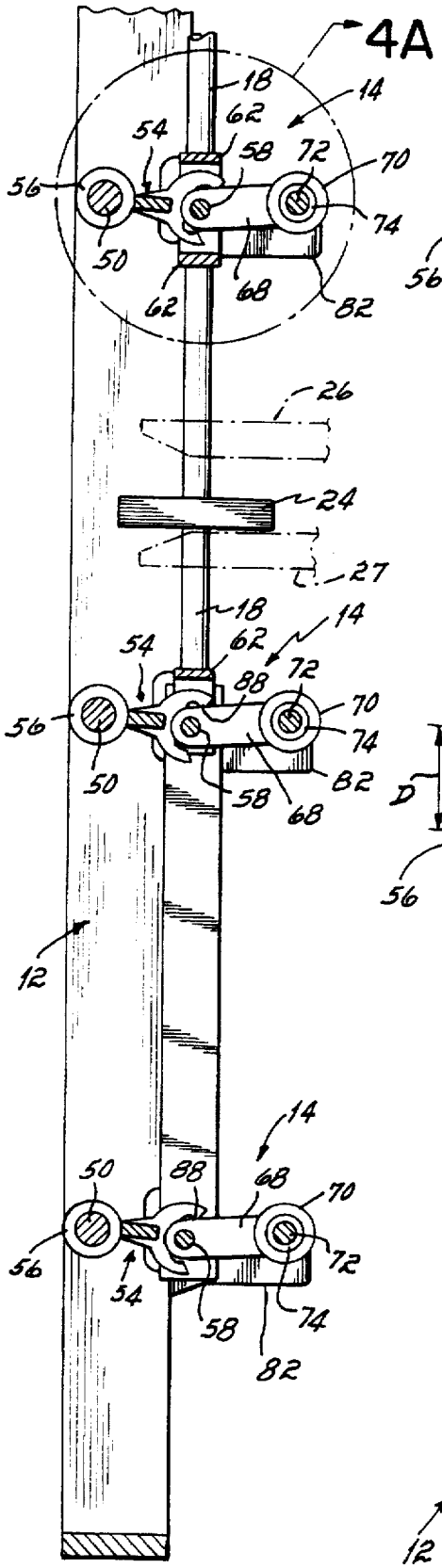
FIG. 3 is a cross-sectional view taken along line 3—3 of FIG. 1 to illustrate the toggle mechanisms of the invention.

As illustrated in FIG. 4A, the movement of intermediate toggle link pivot shaft 58 and the pivoting of the individual toggle links 54, 68 extends the effective length of the toggle mechanism relative to the shortened length of the unlatched toggle mechanism illustrated in FIG. 4B. The extended toggle mechanism 14 extends between door body 12 and latch hooks 82 and provides an outward force on the flexible latch tension bar 72 proximate its center (see FIG. 3). The latch tension bar 72 flexes about its center with the ends of bar 72 being held by hooks 82. The stored energy of the flexed latch tension bar 72 produces an inward force against the toggle links 54, 68 and against the inner toggle link pivot shaft 50. FIG. 3 illustrates the flexing of the latch tension bar 72 proximate its center when the toggle mechanisms 14 have an extended length. Inner toggle link pivot shaft 50 is coupled to the segmented door body 12 as illustrated in FIG. 2. The sealing force of the flexed latch tension bar 72 is directed inwardly and thus forces the segmented door body 12 and door seal 32 into engagement with jamb sealing surface 35 to provide an effective seal of the door. Referring to FIG. 5, the cross-section 72 illustrates the position of the ends of latch tension bar 72 which are held by hooks 82 while the phantom circle 72*a* illustrates the location of the center of bar 72 when the toggle mechanism has an extended length and the bar 72 is flexed. The position of hooks 82 may be adjusted with respect to jamb 16 by adjustment bolts 84 to increase or decrease the flexing of bar 72 and the sealing force created by bar 72.

Toggle mechanism 14 is locked in a latched state by further downward movement of the latch actuator rod 18 such that the intermediate toggle link pivot shaft passes through the center plane P by a small distance d (see FIG. 4A). Thereby the intermediate toggle link pivot shaft 58 breaks over the center plane P and comes to rest against a surface 88 of the stop structure 66. The shape of stop structure surface 88 and the inward latching force provided by the flexed latch tension bar 72 locks the latch mechanism 14 in an extended length wherein it is held until upward movement of the latch actuator rod (as by element 27) to unlatch the toggle mechanism. When the latch actuator rod 18 is moved toward the top of door 10 the intermediate toggle link pivot shaft 58 is forced back over the center plane P, and the toggle links 54, 68 pivot toward one another such that the toggle mechanism has an effectively shortened length. The shortened toggle mechanism allows the bar 72 to flex back to a rest position and releases the tension of the flexed latch tension bar 72. The upward movement of rod 18 also raises the outer toggle link 68 to clear the latch tension bar 72 from the latch hooks 82 thereby completely unlatching the door 10 and allowing the door to be removed away from jamb 16.

FIG. 3 illustrates a portion of door body 12 which is sealed by a plurality of toggle mechanisms 14 which are in an extended and latched position. The intermediate toggle link pivot shaft 58 of each mechanism 14 is moved either by the latch actuator rod 18 or the latch actuator links 20. The toggle mechanisms 14 of door 10 are all latched and unlatched simultaneously to provide an effective seal for the door. The latch actuator rod is moved vertically upwardly or downwardly by the movement of disk 24 by a door extractor device between stops 26, 27.

Each toggle mechanism 14 independently provides an inward latching force against the door body 12 by way of the independently flexing latch tension bars 72. As a result, the door body 12 is effectively and tightly sealed against door jamb 16 along its length. Since the latching forces are provided independently by each toggle mechanism, the door is sealed more evenly and consistently along its length as opposed to a single biasing structure with a single latching force which is distributed over the length of the door. Furthermore, the combination of the segmented door body and the independent latching forces provided by the individual toggle mechanisms 14 provides parallel engagement between door body 12 and door jamb 16 even when the door jamb is warped or distorted. In accordance with the principles of the present invention, the latching and unlatching of door 10 is provided by a single vertical movement of the latching disk 24. Such translational movement is more efficient than prior art rotational movement mechanisms. Furthermore, the present invention may be latched or unlatched at one position along the length of the door such that the door extractor utilized may be much less complex than those currently required for conventional coke over doors. The multi-latch system of the invention provides a much greater and more efficient distribution of latching forces than has ever been possible.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A coke oven door for placement against the door jamb of a coke oven to seal the oven, the door comprising:

a door body;

a plurality of toggle mechanisms, each toggle mechanism being pivotable and having an extended length when pivoted in one direction and having a shortened length when pivoted in the other direction, inner ends of the toggle mechanisms being coupled to the door body at spaced positions along the length of the door body;

a flexible latch tension bar coupled to an outer end of each toggle mechanism proximate a longitudinal center of the tension bar and configured for engaging a latch connected to the door jamb, the latch tension bar flexing against the latch when the toggle mechanism is pivoted to an extended length for independently biasing the toggle mechanism against the door body to latch the body against the door jamb;

whereby the door body is forced against the jamb by a plurality of independent latching forces at positions along its length for more effective sealing of the oven.

2. The coke oven door of claim 1 wherein the door body comprises a plurality of segments, each of the segments being operable for flexing with respect to adjacent segments to allow the door body to flex along its length when latched against the door jamb.

3. The coke oven door of claim 1 wherein each toggle mechanism comprises an inner toggle link coupled to the door body and an outer toggle link coupled to the latch tension bar, the inner and outer toggle links being pivotally coupled together for pivoting the toggle mechanism between an extended length and a shortened length.

4. The coke oven door of claim 3 wherein one of said inner and outer toggle links includes a mechanical stop structure thereon for maintaining the toggle mechanism in an extended length when it has been pivoted to latch the door body.

5. The coke oven door of claim 3 wherein the links of the toggle mechanism go over center to an extended length to latch the door body.

6. The coke oven door of claim 1 wherein each toggle mechanism comprises an intermediate toggle pivot for pivoting the toggle mechanism between its extended and shortened lengths, the intermediate toggle pivots of the toggle mechanisms being ganged together for simultaneous pivoting of the toggle mechanisms to latch the door body along its length.

7. The coke oven door of claim 1 further comprising a latch actuator device coupled to each toggle mechanism, the actuator device being vertically translatable for simultaneously pivoting each toggle mechanism to latch the door body.

8. The coke oven door of claim 7 further comprising a latching structure attached to the latch actuator device, the latching structure configured to be engaged by a door extractor for translation of the latch actuator device from a single location on the actuator device.

9. The coke oven door of claim 1 wherein the latch includes a latch hook for capturing the latch tension bar so that the tension bar may be flexed to latch the door body.

10. The coke oven door of claim 1 further comprising a seal structure positioned on the door body and operable for contacting the door jamb when the door body is latched for further sealing the coke oven.

11. A coke oven door for placement against the door jamb of a coke oven to seal the oven, the door comprising:

a door body;

a plurality of pivotable toggle mechanisms, each toggle mechanism having an extended length when pivoted in one direction and having a shortened length when pivoted in the other direction, inner ends of the toggle mechanisms being coupled to the door body at spaced positions along the length of the door body;

an elongated biasing device coupled to an outer end of each toggle mechanism proximate a longitudinal center of the elongated biasing device and configured for engaging a portion of the door jamb, the biasing device pressing against the door jamb portion when the toggle mechanism is pivoted to an extended length and independently forcing the respective toggle mechanism against the door body to force the door body against a sealing surface of the door jamb and thereby latch the door body against the door jamb;

whereby the door body is forced against the jamb sealing surface by a plurality of independent latching forces at positions along its length for more effective sealing of the oven.

12. The coke oven door of claim 11 wherein the door body comprises a plurality of segments, each of the segments being operable for flexing with respect to adjacent segments to allow the door body to flex along its length when latched against the door jamb.

13. The coke door oven of claim 11 wherein each toggle mechanism comprises an inner toggle link coupled to the door body and an outer toggle link coupled to the biasing device, the inner and outer toggle links being pivotably coupled together for pivoting the toggle mechanism between an extended length and a shortened length.

14. The coke oven door of claim 13 wherein one of said inner and outer toggle links includes a mechanical stop structure thereon for maintaining the toggle mechanism in an extended length when it has been pivoted to latch the door body.

15. The coke oven door of claim 13 wherein the toggle links of the toggle mechanism go over center to an extended position to latch the door body.

16. The coke oven door of claim 11 further comprising a latch actuator device coupled to each toggle mechanism, the actuator device being vertically translatable for simultaneously pivoting each toggle mechanism to latch the door body.

17. A coke oven comprising:

an oven chamber having an opening;

a door jamb positioned proximate said oven chamber opening, the jamb having a sealing surface;

a coke oven door for placement against the door jamb sealing surface to seal the oven, the door comprising:

a door body;

a plurality of toggle mechanisms, each toggle mechanism being pivotable and having an extended length when pivoted in one direction and having a shortened length when pivoted in the other direction, inner ends of the toggle mechanisms being coupled to the door body at spaced positions along the length of the door body;

a flexible latch tension bar coupled to an outer end of each toggle mechanism proximate a longitudinal center of the tension bar and configured for engaging a latch connected to the door jamb, the latch tension bar flexing against the latch when the toggle mechanism is pivoted to an extended length for independently biasing the toggle mechanism against the door body to latch the body against the door jamb sealing surface;

whereby the door body is forced against the jamb sealing surface by a plurality of independent latching forces at positions along its length for more effective sealing of the oven.

18. The coke oven of claim 17 wherein the door body comprises a plurality of segments, each of the segments being operable for flexing with respect to adjacent segments to allow the door body to flex when latched against the door jamb sealing surface such that the segments of the door are maintained relatively parallel with portions of the jamb sealing surface for more effective sealing of the oven.

19. The coke oven of claim 17 wherein each toggle mechanism comprises an inner toggle link coupled to the door body and an outer toggle link coupled to the latch tension bar, the inner and outer toggle links being pivotally coupled together for pivoting the toggle mechanism between an extended length and a shortened length.

20. The coke oven of claim 19 wherein the toggle links of the toggle mechanism go over center to an extended position to latch the door body.

21. The coke oven of claim 17 further comprising an actuator device coupled to each toggle mechanism, the actuator device being vertically translatable for simultaneously pivoting each toggle mechanism to latch the door body against the door jamb to seal the oven.

22. A method of sealing a coke oven comprising:

positioning a door body against a door jamb of the oven, the door body including a plurality of extensible toggle mechanisms which are pivotable between an extended length and a shortened length, inner ends of the toggle mechanisms being coupled to the door body at spaced positions along the length of the door body and outer ends coupled to respective flexible latch tension bars proximate longitudinal centers of the tension bars;

coupling the latch tension bars to respective latches connected to the door jamb;

pivoting the toggle mechanisms to an extended length for flexing the latch tension bars against the latches such that latch tension bars provide independent latching forces against the toggle mechanisms and the door body to latch the door body against the door jamb;

whereby the door body is forced against the door jamb by a plurality of independent latching forces at positions along its length for more effective sealing of the oven.

23. The method of claim 22 wherein the door body is segmented, the method further comprising flexing the door body at the segment junctures such that segments of the body are maintained relatively parallel with the door jamb when the door body is latched against the jamb.

24. The method of claim 22 further comprising locking the toggle mechanisms in their extended length to maintain the door body latched after the toggle mechanisms have been pivoted.

25. The method of claim 22 further comprising pivoting all of the toggle mechanisms simultaneously to latch the door body against the door jamb.

26. The method of claim 22 wherein the toggle mechanisms go over center to extended length to latch the door body.

27. A coke oven door for placement against the door jamb of a coke oven to seal the oven, the door comprising:

a door body comprising a plurality of segments, each of the body segments operable for flexing, at flex positions along the door body, with respect to adjacent body segments to allow the door body to flex along its length;

a plurality of pivotable toggle mechanisms, each toggle mechanism having an extended length when pivoted in one direction and having a shortened length when pivoted in the other direction, inner ends of the toggle mechanisms being coupled to the door body at flex positions on the door body;

a biasing device coupled to an outer end of each toggle mechanism and configured for engaging a portion of the door jamb, the biasing device pressing against the door jamb portion when the toggle mechanism is pivoted to an extended length and independently forcing the respective toggle mechanism against the door body to force the door body against a sealing surface of the door jamb and thereby latch the door body against the door jamb;

whereby the door body is forced against the jamb sealing surface by a plurality of independent latching forces at positions along its length for more effective sealing of the oven.

28. A coke oven door for placement against the door jamb of a coke oven to seal the oven, the door comprising:

a door body;

a plurality of toggle mechanisms, each toggle mechanism being pivotable and having an extended length when pivoted over center in one direction and having a shortened length when pivoted in the other direction, inner ends of the toggle mechanisms being coupled to the door body at spaced positions along the length of the door body;

a flexible latch tension bar coupled to an outer end of each toggle mechanism and configured for engaging a latch connected to the door jamb, the latch tension bar flexing against the latch when the toggle mechanism is pivoted to an extended length for independently biasing the toggle mechanism against the door body to latch the body against the door jamb;

a mechanical stop structure on at least one of said toggle mechanisms, the stop structure operable for maintaining the toggle mechanism in said extended length when the mechanism is pivoted over center;

whereby the door body is forced against the jamb by a plurality of independent latching forces at positions along its length for more effective sealing of the oven.

* * * * *